US005548846A

United States Patent [19]

Bianchetti

[11] Patent Number: 5,548,846

[45] Date of Patent: Aug. 27, 1996

[54] HEADWEAR WITH DETACHABLE BRIM

[76] Inventor: George Bianchetti, 1146 Second Ave., B-4, New York, N.Y. 10021

[21] Appl. No.: 366,829

[22] Filed: Dec. 30, 1994

[51] Int. Cl.[6] ..... A42B 1/18

[52] U.S. Cl. ..... 2/209.12; 2/10; 2/171.03; 2/175.2; 2/175.4; 2/195.5; 2/209.13

[58] Field of Search ..... 2/4, 7, 10, 12, 2/15, 171, 171.03, 175.1, 175.2, 175.3, 175.4, 175.6, 195.1, 195.5, 202, 205, 206, 207, 209.11, 209.12, 209.13

[56] References Cited

U.S. PATENT DOCUMENTS

| | | | |
|---|---|---|---|
| 1,946,998 | 2/1934 | Armstrong | 2/209.11 |
| 2,728,913 | 11/1956 | Connor | 2/10 |
| 5,406,645 | 4/1995 | Lin | 2/10 |

FOREIGN PATENT DOCUMENTS

| | | | |
|---|---|---|---|
| 23174 | 3/1908 | United Kingdom | 2/175.3 |

*Primary Examiner*—Diana Biefeld
*Attorney, Agent, or Firm*—Grimes & Battersby

[57] ABSTRACT

This invention pertains to headware equipped with a weather and environmental protection device insert that stores in a hidden fashion within the headware, and instantly self expands upon removal and upon reattachment to the headware exterior forms a effective protection unit to the head and body of the wearer. The protection device consists of one or more sphere shaped panels, each with a perimeter border of coilable spring wire formed in a loop, such loop covered with a variety of foldable protective fabric to form side or overhead panels. That these panels can deploy singly overhead to create a wide brim effect offering protection from sun and rain, or that such panels can also be joined together to create a tentlike protective framework about the head and body of the wearer. In either design, the protection device is easily coilable from its deployed broad cover by twist-fold pressure to form a small stack of concentric, over lapping spheres that fit comfortably and unobtrusively in the crown of the supporting headware. The protective device is adaptable to a variety of standard off-the-shelf headware as well as to designs that incorporate the headware/protective device as one matching unit in a variety of fashion styles for men and women.

4 Claims, 5 Drawing Sheets

HEADWEAR WITH DETACHABLE BRIM

BACKGROUND OF THE INVENTION

1. Field of the Invention

The present invention relates generally to an article of headware and, more particularly, to a cap or hat that can be worn by either a man or woman which incorporates a weather/environmental protection device or shade which is adapted to be readily transformed back and forth into said article of headware.

2. Description of Prior Art

There have been many attempts to incorporate sunshades and weather protection devices into caps and hats. The prior art discloses many rigid support structure designs that convert into umbrella type protection devices. These are generally cumbersome, expensive, bulky and unlikely to appeal to a broad base of consumers because of the obvious and unflattering nature of their appearance. A decision to wear one of these devices is almost akin to a decision to carry a standard umbrella.

For example, U.S. Pat. No. 276,753 which issued on May 1, 1883 to S. B. Bartine describes a hat which includes an umbrella like sunshade with braces and ribs. U.S. Pat. No. 283,353, which issued on Aug. 14, 1883 5 to W. Munz, is directed to a hat having a sunshade which includes a plurality of ribs to provide the necessary shape for the shade. A sportsman's convertible hat is described in U.S. Pat. No. 748,950 which issued on Jan. 5, 1904 to E. E. Hodshon in which a foldable sun or rain shade may be folded or secured around the outer side of the hat when not in use.

Similarly, U.S. Pat. No. 1,187,507 which issued to E. M. Coyne on Jun. 20, 1916 is directed to a convertible hat having a crown embodying an elliptical band constructed of sheet metal which is adapted to expand outwardly and form a sun shade or umbrella shape. U.S. Pat. No. 2,856,607 which issued to W. H. Richardson on Oct. 21, 1958 relates to a rain hat which incorporates a veil made of a thin, soft material. In U.S. Pat. No. 4,760,610 which issued to B. T. Wu et al. on Aug. 2, 1988, an umbrella cat hat is provided in which a canopy is provided for supporting the umbrella on the cap. U.S. Pat. No. 4,980,928, which issued to A. Ellis on Jan. 1, 1991, teaches a convertible cap and cape combination.

A cap and mask organization device is the subject of U.S. Pat. No. 5,035,004 which issued on Jul. 30, 1991 to E. J. Koester in which a mask is adapted to be attached to a baseball type cap by a Velcro type hook and loop fastening system. Swiss Patent No. 194057 is directed to a cap device which includes an umbrella adapted to be mounted on the top of the cap.

See also, U.S. Pat. No. 2,344,811 which issued on Mar. 21, 1944 to F. A. Gill for an insect repelling fabric and garment; U.S. Pat. No. 2,462,259 which issued on Feb. 22, 1949 to M. A. Dannenberg for a cap which includes means to protect and face and head; U.S. Pat. No. 2,726,668 which issued on Dec. 13, 1955 to B. B. Levine for a parasol adapted to mounted on a cap; U.S. Pat. No. 3,150,380 which issued on Sep. 29, 1964 to R. Porcello for a ventilated hat; U.S. Pat. No. 3,469,264 which issued to C. J. Harris on Sep. 30, 1969 for a plastic rainwear hood; U.S. Pat. No. 2,998,611 which issued on Sep. 5, 1961 for a duffed cap and face hood which is adapted to fold downwardly.

A review of the prior art disclosed that such framework typically consists of a complex ribbed construction, add-on poles, and various connecting joints and struts. Each design addresses a single protection zone, one generally overhead or about the facial area in a fixed and inflexible design. Other caps or hats in the prior art simply use a framework to house expandable free flowing veils or ponchos. These would lack the desired benefit of providing away from the body protection in a tent-like enclosure that would offer the greatest comfort to the wearer. Other prior art designs require that the hat and protective device be integrated as one which does not allow for the addition of a practical weather protection device to a off-the-shelf or previously purchased hat. This is quite relevant today as it is the multitude of cap/hat styles and decorative emblazoned designs that make them so appealing to a wide range of consumers.

3. Summary of the Invention

Against the foregoing background, it is a primary objective of the present invention to provide a hat or cap having an expandable protective device or shade cover.

It is another object of the present invention to provide such a hat in which the protective device is instantly deployable for use yet may quickly recoil for insertion back to its original storage site within the headware.

It is yet another object of the present invention to provide such a protective device that may be used within hats of varying styles in common use and does not materially impact the outward appearances of the hat.

It is still another object of the present invention to provide such a protective device that may be used with off-the-shelf headware as well as with specially designed headware.

It is still yet another object of the present invention to provide such a hat or cap having at least one lightweight, simple and flexible framing sphere, which would provide the comfort of a framework for the protective device over a relatively broad area.

It is yet another object of the present invention to incorporate a hat with one such sphere which, upon deployment, would expand horizontally to act as a sunshade or overhead umbrella.

It is still another object of the present invention to combine two or more such spheres and deploy them vertically as hanging panels in an interconnected manner to create an interior space tentlike comfort zone upon deployment to the benefit of the face, neck and upper body area.

It is but another object of the present invention to provide such a hat or cap which includes interior space comfort zones and a variety of covering fabrics that may be used to further the beneficial applications, ranging from water/wind resistant fabric to mesh, reflective foil, and air filter inserts.

It is still yet another object of the present invention to provide such a hat or cap wherein the framework based fabric protection be supplemented with additional free flowing fabric for lower body protection as an option on applicable designs.

To the accomplishments of the foregoing objects and advantages, the present invention, in brief summary, comprises a combination hat/cap and weather or environmental protection device for use by a wearer. The claimed invention provides the opportunity to address these concerns in a manner distinguishable from the prior art.

For example, the claimed invention utilizes spheres constructed of flexible spring wire to which appropriate fabric is stitched to form a protective, taut, and continuous covering. These spheres are twistable and foldable into a figure 8 configuration that is a one-third dimension of their fully expanded size. Further, the collapsible nature of these spheres, in combination with the spring wire utilized, makes them self-expanding in nature. Not only can the spheres fit comfortably within a basic hat structure, but they instantly open when removed from within for reattachment to the outside of the hat. Similarly, they instantly fold for reinsertion to the storage site within the hat when not in use.

As an example, a sphere with a 20" diameter coils down into three pancake like spheres measuring only 7" in diameter, small enough to fit inside a standard size hat. This would allow consumers to purchase only the weather protection device/sphere with attachment kit, for use with their existing hat. Similarly, hats with integrated spheres sold as a unit, would be virtually identical to current styles and hat styles, although perhaps a bit oversized to compensate for a sphere insert of the desired size and use.

In that regard, one or more spheres can be used to provide a variety of flexible uses and designs. A single sphere can be employed in a horizontal design to form a wide brim add-on to the hat, effectively turning it into a sun shade or rain cover. The single sphere could have a hole opening in the center to accommodate the hat and act simply as the wide brim, or it could have a soft built-in cover for the center section that would rise and act as a fitted cover for the hat when used for rain protection. With a single sphere insert, a ballcap or beret shaped hat can easily be transformed into a wide brim hat applicable for sun/rain protection.

It should be noted that when the spheres are twist-folded down into their figure 8 configuration, the spring wire frame forms a circular band on the perimeter border, with the soft fabric occupying the inner core of all three loops. Thus when stored against the upper/inner portion of the hat, the soft fabric acts as a comfortable ceiling for the head of the wearer, in effect becoming the inner top of the hat.

This feature, in combination with lightweight, space age material now in existence, makes it possible to store several loops compactly and comfortably within the hat at one time. The stitch joining of one or more spheres together can then create a variety of protective designs, each offering the advantages of tent-like protection. For example, a series of four interconnected spheres may act as a protective dome, hanging down in a vertical design from the hat of the wearer, to which it is attached and is supported. Similar tent-like protection zones may be derived by using other vertical/horizontal combinations of interconnected spheres (e.g., 2,3 or more), and can vary in the length of protection offered from the head to the waist area. Once the preferred design has been established by the consumer, the claimed invention also offers to provide flexible protection based on the materials used in construction and stitched to the frame. Thus, a hanging dome style could offer weather resistant material for protection against driving wind and rain. Yet the same dome design could also be applicable to insect protection with the use of a mesh material, or for body heat retention purposes after outdoor athletics with the use of heat reflective material. With the addition of a drawstring type close-off at the bottom of the dome, whether it be at neck level or waist level, the design could also be utilized as a pollen/smog protection with the use of replaceable yet built-in air filter material sections.

Such protection device essentially consists of a frame formed from material that is relatively strong but flexible enough to allow it to be coiled. In one embodiment of this invention, the material used may be of flat spring steel stock with a width of about 1.6 mm, and a thickness of about 0.50 mm. Other frame materials may include plastic materials having a relatively high bending or elasticity properties, and may be in the form of a flat strip also. The ends of the frame stock can be secured together by any means including heat stamping, riveting, bracket or adhesive. Once the ends are secured, the resulting circular shaped spheres are therefor collapsible loop members which can be twisted and folded into a figure 8 configuration for compact storage. In the case of the present invention, a single frame sphere with a 20" diameter could therefore collapse into a 3 tiered pancake form with roughly a 7" diameter. Such collapsed form could then be easily be fitted into a standard size hat for storage and, upon release from the hat, would self-expand instantly to its 20" diameter protection sphere.

Once the frame spheres are formed from the flat strip, flexible material, the spheres are then covered with cloth like durable and lightweight materials such as Nylon or Dacron. In the event of special applications other materials may be used such as aluminized polyester for use as a heat reflector. Once the appropriate material is selected, it is then attached, in one embodiment via sew stitching, to the perimeter frame member. When folded into a figure 8 configuration, the resulting three-tiered pancake presents the hard frame material as the outer perimeter border with the soft material forming a soft inner cushion. This would provide the soft ceiling against the head of wearer when stored within the hat. Stitch sewing, or otherwise attaching the soft cloth-like material to the frame member presents an opportunity to modify the circular appearance of the sphere. Using slight frame compression the form of the sphere may be altered to resemble a oval, oval squared, rounded triangle or other such effect which may be employed in those designs requiring two or more attached spheres. Thus stitching is used as a means of applying tension to frame.

In the case of the overhead sunshade design, or umbrella design, only one sphere is used. Upon deployment from its storage site within the hat, the protection sphere instantly self-expands reattached via connector. devices such as buttons, Velcro type hook and eye fastening devices, clasps or the like, to the outside of the hat. This sphere could appear in two forms, one with a center hole that allows the worn cap to be exposed, the other with center cover that would be fitted upwards to protect the hat as well. The center hole option would be used in those designs requiring a wide brim for sun-shade purposes, at the same time allowing for the ventilated designs of the cap to demonstrate themselves. The covered center section would be used for the umbrella designs and would protect against rainfall in its entirety. All designs would offer chinstraps and other such features that would more firmly attach the spheres to the face or body areas against wind gusts. In another variation on this design, the sun-shade with center hole may be supplied with a detachable center cap cover, which may also be stored inside the cap for use in the event of rain. Thus the center hole sphere would be equipped with two sets of attachments, one to attach to the hat, the other to attach the center cover to the center hole border so that the cap may also be covered.

In a second approach that opens up a variety of practical and useful designs, two or more spheres are interconnected via stitched clothlike material to create sphere side panels, the resulting effect being a tentlike interior protective space. When 3, 4 or more such panels are used, for example in a dome shaped hanging design, the joining side panels are hinged together via stitching, the hinging being attached to its adjacent side members at all times. In one embodiment of this invention, the operable method for folding the multiple panel spheres used in this design is to overlay the spheres and form a stack. Thus it is then possible to simultaneously twist-coil the thusly formed stack into three overlaying hoops for reinsertion back into the hat storage area. When deploying for use, the self expanding panel spheres include a compression means for shaping the expanded frame of each side panel sphere into a predetermined configuration, as in the case of the dome design. In one embodiment, both the top and bottoms of the dome are compression held by stitched and re-enforced foldable fabric. The top being a soft cloth mini-dome designed to attach to the cap, protect it, and effectively allow the wearer to support the hanging dome from the head, leaving the hands free for other use. Similarly, the bottom of the dome has an opening to allow for the body torso to exit, but which may have a partial floor of soft fabric that both serves to compress the dome to its desired form at the lower end, and also allows the use of a drawstring type mechanism to provide for a fitted adjustment to the lower body measurement. This would also add to the stability of the dome on the lower end when in use.

Thus by protecting the head, face, neck, and upper body area in such a frame supported, away from the body, interior space, a variety of applications become possible. In one embodiment, the foldable fabric covering material would be of lightweight, water/wind resistant properties to allow protection from wind and rain. In another embodiment, the foldable fabric would consist of a fine mesh to protect against mosquitos and other insects. In another embodiment, the foldable fabric would consist of reflective foil that would serve to reflect body heat back into the protected interior space. In another embodiment, the folded fabric would include sections of air filtering respiratory materials, which could protect against pollen, dust, and other airborne environmental hazards. These can be replaceable as sections within the overall fabric sphere panels.

All of the designs using multiple numbers of sphere panels to create a protected interior space would have the necessary ventings, resealable openings, attachments, stabilizer straps and clear-vision design that would allow for safe and comfortable use of the protection device. Similarly, all designs would provide the necessary clasps, holders, and attachments to insure that the protection device, upon storage within the hat, remains comfortably seated in its assigned space within the hat when not in use. In one embodiment, the protection zone provided by the dome framework design extends downward from the hat to the torso waist area. To extend protection to the lower body area, connectors may be built-in to the lower end of the dome floor area, from which a hanging drape may be attached in such fashion as to provide both protection and unrestricted movement when in motion. Such drape would also be foldable for compact storage and may also be stored within the hat, form a removable headband on the outside of the hat, or may be carried as an accessory. Where required, designs would also feature resealable openings to allow for arm entry/exit. Additionally, the interior space could also feature or accommodate such amenities as a battery operated reading light, rear viewer reflectors, and radio headset, all of which are now on the market as add-on features to headware. Finally. all designs would allow for imprinted messages or designs on the deployed protection device, which would be particularly effective due to its vertical, hanging and visible orientation.

Another distinguishable feature of the disclosed invention is the ability to adapt the weather protection device into previously purchased, or new off-the-shelf headware selections, as well as a dedicated article of headware specifically designed to incorporate the protective device. There are varying styles of new hat designs that could accommodate a smaller version of the weather protection device invention. For example, a beret, army officers hat and Scottish hat by design, all have crowns that extend outward and are larger than the fitted headband. Thus, even though they have little height to offer above the headband, they may comfortably accommodate a device with a larger diameter than the standard size 7, or 7" as mentioned earlier. The fact that the frame loop structure would extend outward from the headband, e.g., 8" diameter, means that the center soft ceiling of foldable material would make a comfortable cushion ceiling within the hat and could accommodate a multiple sphere device. Other style hats, such as western or ball caps, have higher and narrower crowns and would require a closed sphere device somewhat smaller than the headband size to allow insertion and storage high up inside the hat. A hat specifically designed to accommodate the weather device of choice would therefore compensate to provide for the diameter/number of sphere design chosen, and design it to be harmonious with both the outward appearance and fitted comfort of the hat. Also, as part of the flexibility of the proposed invention, the device can present itself in several modes. In one embodiment it is a protection device with attachment kit for insertion into an existing hat. In another embodiment the protection device is integrated into a dedicated design for a particular hat and purchased as a single item. In still another embodiment, the protection device is simply attached to a fitted headband and itself acts as the crown ceiling which may then be detached, deployed and reattached to the headband.

One of the key advantages to proposed invention is that, by its storage in fitted comfort within a hat, the consumer no longer has the burden of carrying another device such as an umbrella to guard against the threat of rain, for example. However for some consumers not accustomed to wearing hats at all times, another embodiment of the invention proposed a design that combines the protection device with a permanently affixed supporting headware. In this design the unit may be carried until such time as weather conditions require its deployment, with the built-in headware support also deploying for use along with the protective device. A soft material elastic headband may be all that is required to firmly provide the head support in this regard.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
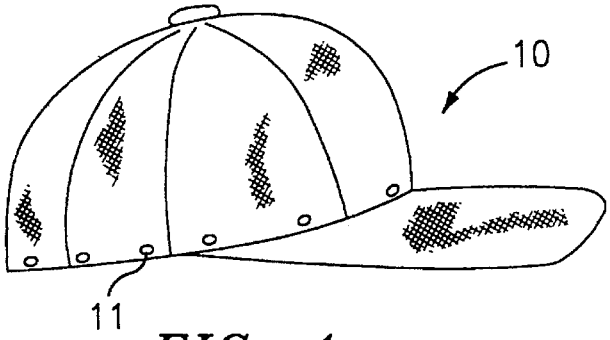
FIG. 1 is a side elevational view of the hat of the present invention with the protective device in a collapsed, unengaged position.
Figure 2:
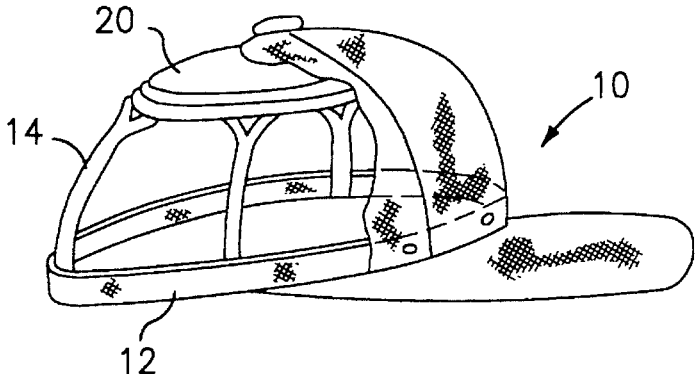
FIG. 2 is a cutaway elevational view of the hat of the present invention illustrating the protective device collapsed within the hat.
Figure 3:
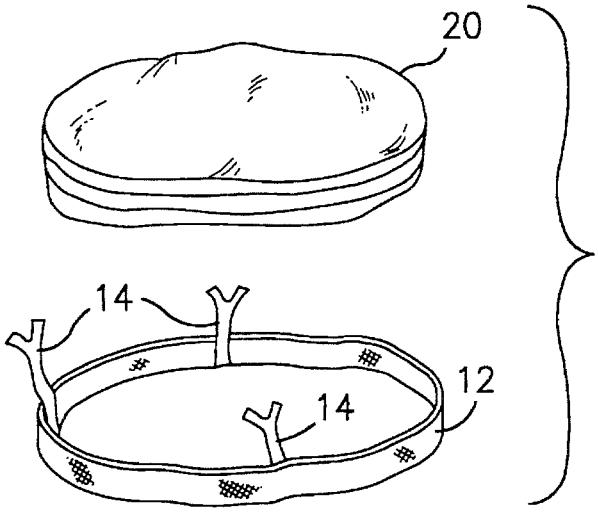
FIG. 3 is an exploded view of the protective device of the present invention in a collapsed, unengaged position.
Figure 4:
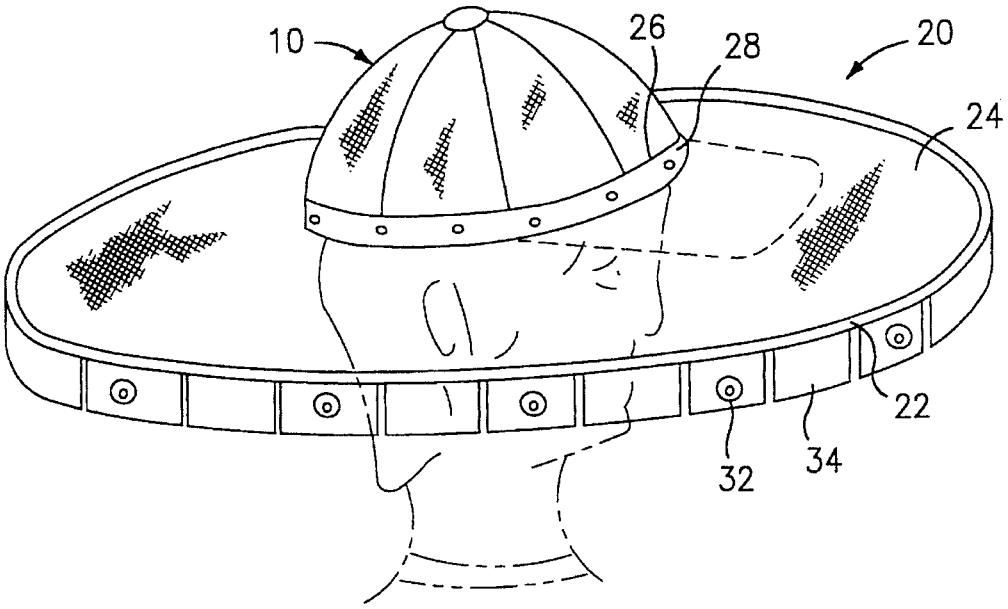
FIG. 4 is a side elevational view of the hat of the present invention illustrating the protective device in a collapsed, engaged position.

Referring to the drawings and, in particular, to FIGS. 1–4 thereof, there is illustrated the article of headwear of the present invention referred to generally by reference numeral 10. As shown in these Figures, article 10 may assume the shape of a typical baseball type cap although it should be understood that alternative configurations and shapes are clearly encompassed within the scope of the invention. For example, it will be appreciated that the article of headware can include hats such as officers hats, berets, sports caps, hunting hats, cowboy hats and pullover knit watch caps As shown in greater detail in FIGS. 2–3, cap 10 includes a plurality of fastening devices 11 provided on the outer edge of the cap 10 along the traditional sweatband 12. At least two and preferably three or more supports 14 are attached to the inside surface of the sweatband 1 2 which are adapted to support a collapsed protective device 20 within the cap 10. Sweatband 12 may be fixed or adjustable.

Protective device 20 is shown in greater detail in FIGS. 5A–F and constitutes a pancake style, folded spring loop protective device which includes an outer, flexible spring 22 which defines the periphery of the device 20 and a cover 24, preferably of fabric or vinyl material, which extends over the spring 22. The cover 24 should be waterproof to serve as a protective device of the wearer to shield them from sun or rain.

The protective device 20 is similar in structure to the collapsible structure described in U.S. Pat. No. 5,038,812 which issued on Aug. 13, 1991 to Lowell R. Norman entitled "Quickly Erectable, Quickly Collapsible Self Supporting Portable Structure," the disclosure of which is hereby incorporated herein by reference thereto.

In a fully opened position (FIG. 5A), the flexible outer spring 22 causes the device 20 to fully open. An open center portion 26 is provided which includes a ridge 28 having a plurality of fastening device 29 for securing the cover 24 to cap 10 at complimentary fastening device 11 provided on the cap 10 as shown in greater detail in FIG. 4

Figure 5A:
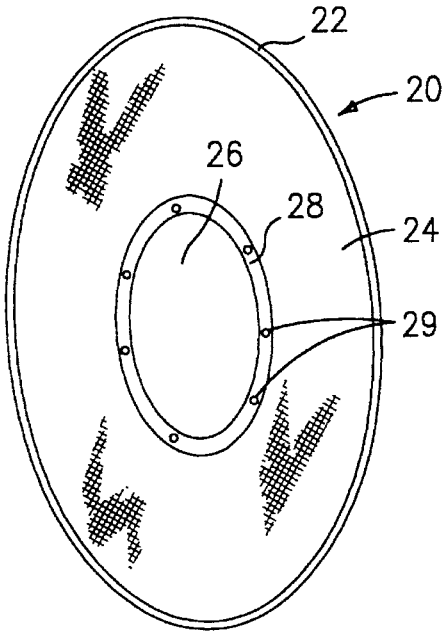
FIGS. 5A–F are side elevational views of the protective device of the present invention illustrating the manner in which the protective device is transformed from a collapsed position to an engaged position.
Figure 5B:
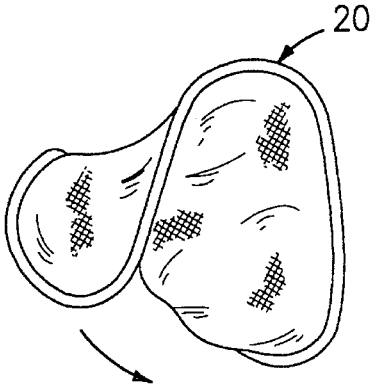
Figure 5C:
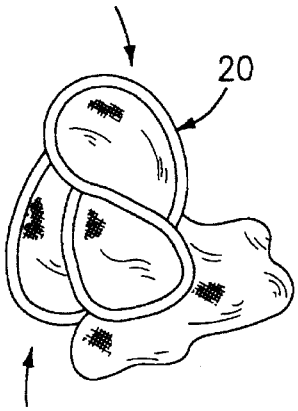
Figure 5D:
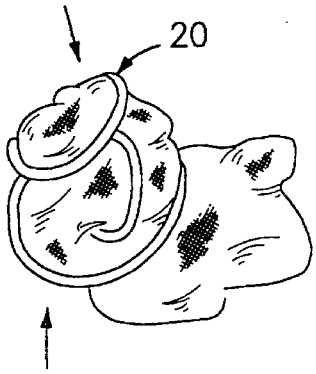
Figure 5E:
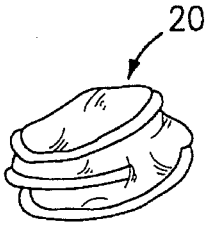
Figure 5F:
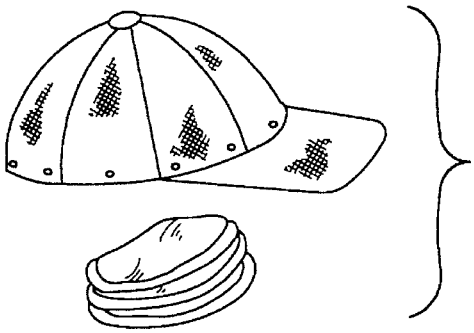

FIGS. 5A–F illustrate the manner in which the cover 24 can be folded in a figure eight configuration for storage under the hat 10 (see FIG. 5F).

Figure 6:
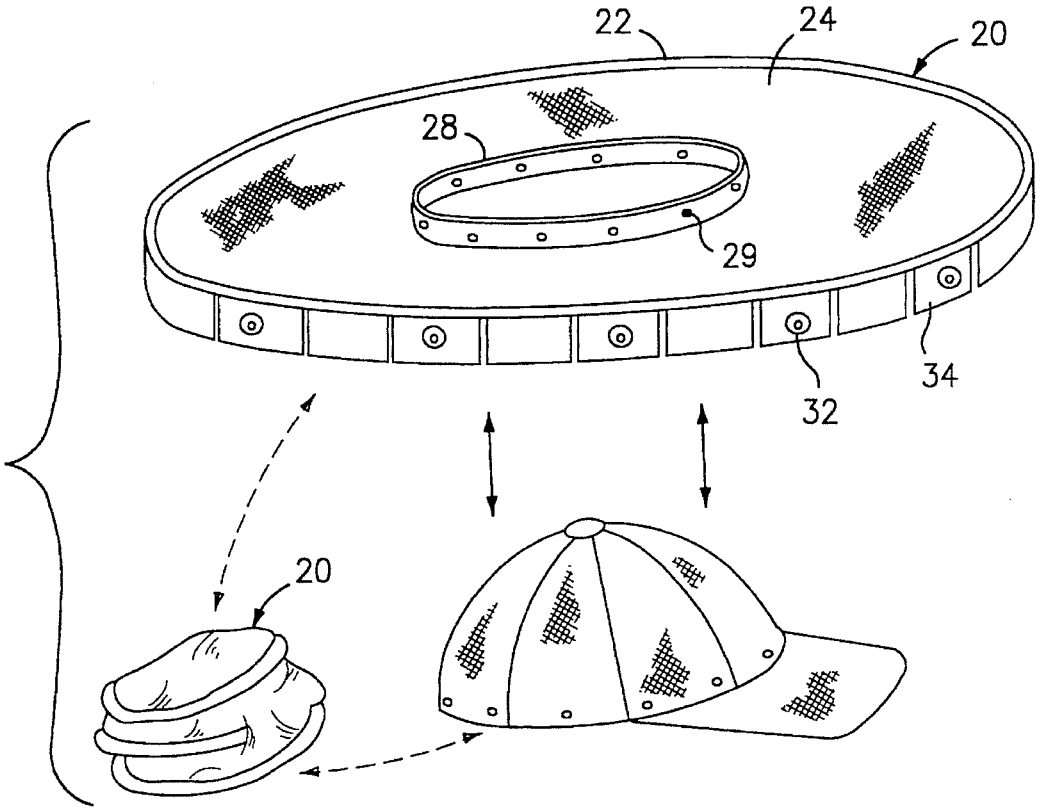
FIG. 6 illustrates the steps to transform the protective device of the present invention from a collapsed position within the hat to an engaged position.

FIG. 6 illustrates schematically how the cover 24 is removed from the inside of the cap 10 and the placed over the cap 10 and secured thereto by fasteners 29 which are adapted to engage complimentary fasteners 11 on the outside of the cap 10.

Figure 7:
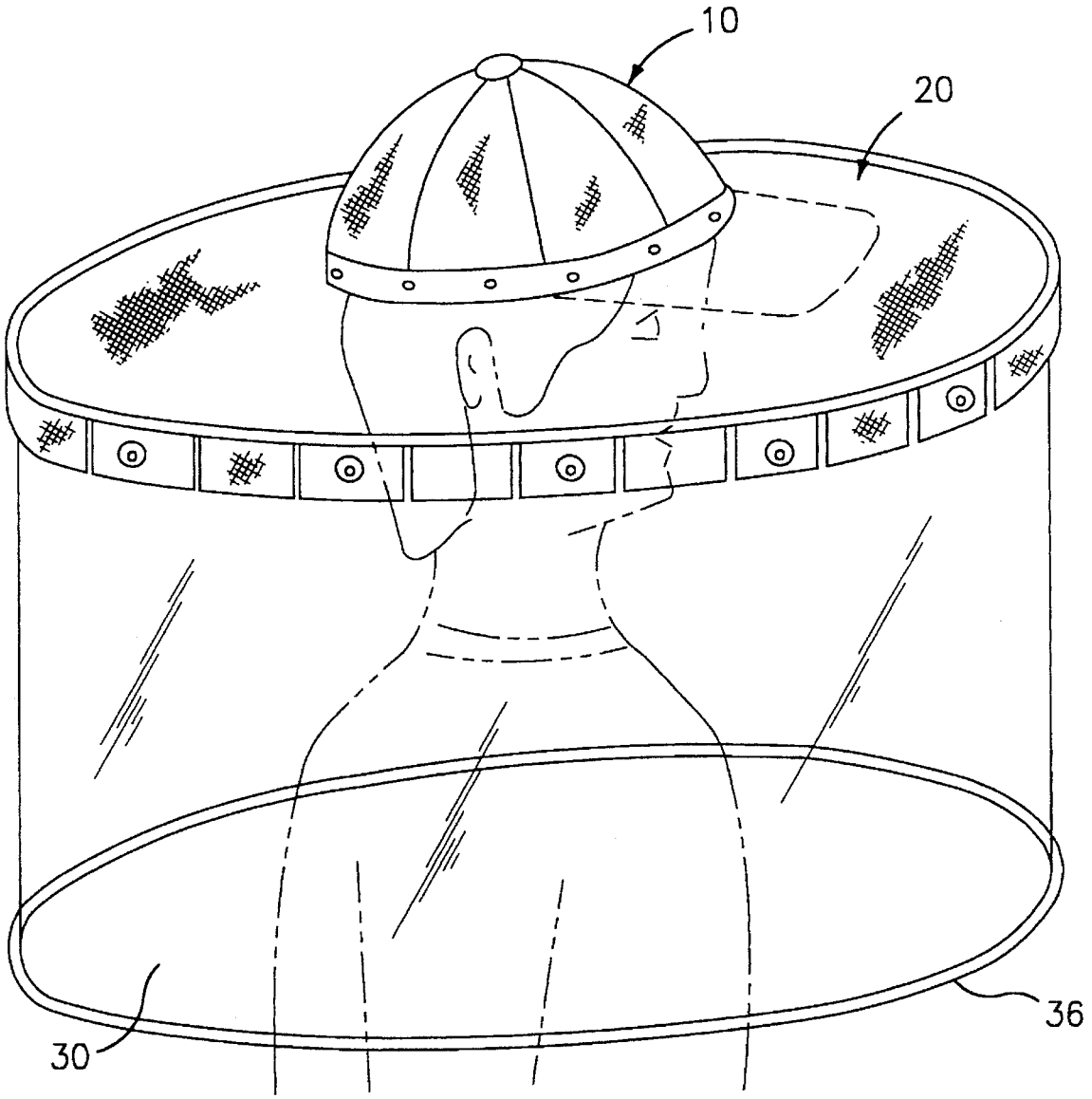
FIG. 7 is a side elevational view of an alternative version of the protective device of the present invention.

The protective device may include a drape or tent portion 30 which is adapted to extend downwardly from the spring 22 about the periphery of the cover 20. As shown in FIGS. 6–7, fastening devices 32 are provided on an outer fringe 34 of the cover 20 for securing the drape 30 thereto. A lower drape spring 36 may be provided to provide weight and shape to the drape 30 and cause it to extend downwardly in order to protect the wearer. It will, of course, be appreciated that the drape 30 may be fabricated from any protective material such as, for example, vinyl or treated fabric. Due to the fact that the drape may cover or otherwise obscure the wearer's eyes, it is preferred that the material be transparent to permit the wearer to be able to see through the drape. Alternatively, windows or openings 38 may be provided to permit the wearer to able to see through the drape 30.

The protective foldable panels provide weather/environmental protection upon deployment to the head, neck, shoulders and body of a person within a mini tentlike interior space framework. The panels are similar in structure to the collapsible shade structure identified in U.S. Pat. No. 5,301,705 which issued on Apr. 12, 1994 to Yu Zheng, the disclosure of which is hereby incorporated herein by reference thereto. Such panels are adapted to provide protection from a variety of weather and environmental concerns and is flexible as to the protective characteristics of the foldable, clothlike material employed to address one or more of such concerns in any specific design. The collapsible protective panels therefore utilize materials which are lightweight, strong, water and wind resistant so as to provide protection from wind and rain. The foldable clothlike drape may include a headband for storage inside the hat.

The collapsible panels may also utilize materials that are of mesh material for addressing concerns of insects such as mosquitoes. The collapsible panels may also utilize materials that are heat reflective so as to address the concerns of body heat loss and to provide protection from the sun.

The collapsible panels may also utilize permanent or replaceable air filtration materials for addressing the concerns of dust, pollen and other pollution concern. That along with the panel device, the accompanying roof, floor, and supporting hat also utilize such materials as needed to improve both protection and air circulation.

The protective device may also contain necessary air circulation and safety features including air vents, resealable zippered openings, clear-view material to insure unobstructed vision, and body strap attachments to improve stability. Arm entry/exit resealable openings may also be provided.

The combination is adaptable to provide flexibility in design appearance so that appropriate designs, logos, advertising messages and the like may be properly administered for viewing.

Figure 8:
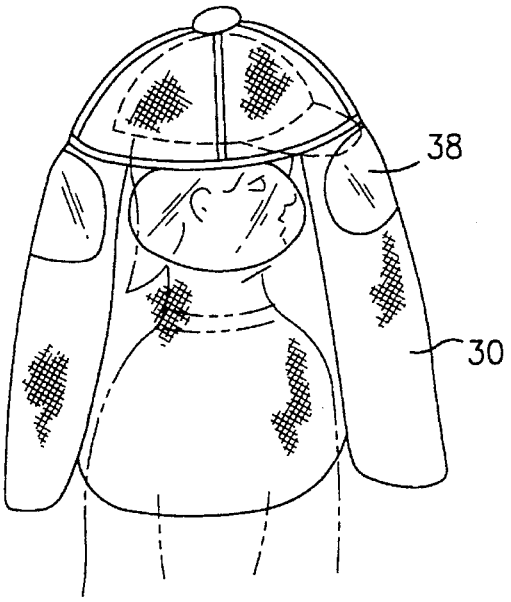
FIG. 8 is a perspective view of an alternative version of the protective device of the present invention.
Figure 9:
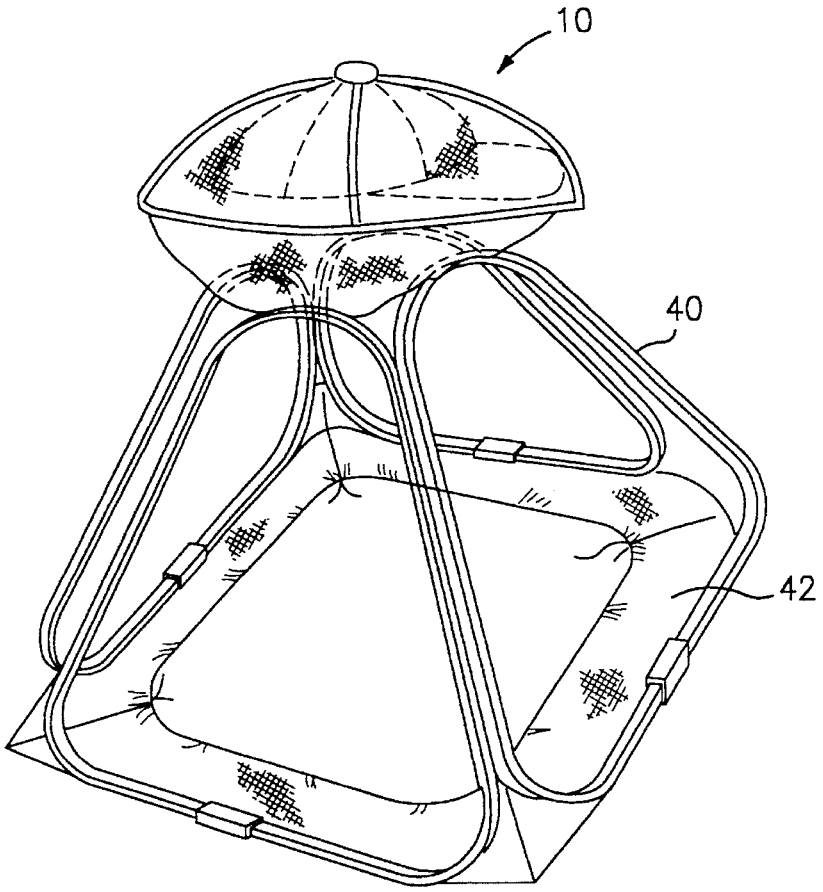
FIG. 9 is a partial cut-away view illustrating the frame structure of the protective device of FIG. 8.

It is further possible to provide a shape or form to the drape 30 by the use of an internal spring structure 40 as shown in greater detail in FIGS. 8 and 9. Spring structure 40 includes a plurality, preferably four, sections of springs which are covered by fabric or protective material to form the drape 30. A lower weighted portion 42 may be provided.

The device consists of three or more foldable panel members each having a folded and unfolded orientation. Each panel member comprises three or four sides with rounded apexes that form a continuous loop in the unfolded configuration. The three or more hinged panels with their corresponding frame members are folded to overlay on top of each other. By twisting and coiling, the panels are urged to form a plurality of concentric frame members and side panels to substantially reduce the size of the protective device, thus allowing for efficient, compact storage within the hat. The reduced coiled storage pack have the frame members as the perimeter in each case, with the soft cloth like material forming the inner core in each case, to rest against the head of the wearer when in a stored position within the hat.

The side panels are vertically inclined at an angle towards the hat so as to create a domed structure in which the interior area of the structure gradually decreases from the bottom to the top, all of which comfortably surround the upper body and head areas.

It should be appreciated that the article of headwear may include a variety of add-on features to enhance the appeal of the created interior space including a battery powered reading light, a mini-fan, a rear view mirror, a radio headset or power glasses, all of which may be affixed to the article or supporting frame by a clasp or other suitable fastening means.

Having thus described the invention with particular reference to the preferred forms thereof, it will be obvious that various changes and modifications can be made therein without departing from the spirit and scope of the present invention as defined by the appended claims.

Wherefore, I claim:

1. A cap for selectively providing a wearer with protection from the environment, said cap including a removable protective device adapted to be stored within said cap, support means within said cap for supporting said protective device within said cap during storage, said support comprising a frame including a band extending about the inside perimeter of said cap with a plurality of upwardly extending support elements for engaging and supporting said protective device when folded, and a first part of a releasable fastening device provided about the outer periphery of said cap for securing said protective device to said cap during use, said removable protective device including:

a sweat band defining an open center portion, said sweat band including a second complimentary part of the releasable fastening device adapted to engage the first part of the releasable fastening device on said cap to removably secure said protective device to said cap;

a continuous, flexible outer spring wire frame; and a weather-proof cover stretched between said sweat band and said wire frame to form a protective device for said cap; wherein said protective device may be removed from and stored within said cap during periods of non-use by unfastening said first part of the releasable fastening device from the second part of the releasable fastening device, twisting said protective device in a figure eight configuration about said continuous wire frame, and folding said twisted protective device into a flat arrangement for storage within said cap supported by the support means provided within said cap to prevent contact between the folded protective device and the head of a wearer.

2. The cap of claim 1, wherein said fastening device on said cap and said protective device comprises complimentary snap fastening devices.

3. The cap of claim 1, wherein said cap further includes means for securing a drape from said protective device for protecting a wearer's body from the environment.

4. A cap for selectively providing a wearer with protection from the environment, said cap including a removable protective device adapted to be stored within said cap, support means within said cap comprising a frame formed from a band and a plurality of upwardly extending support elements for supporting said protective device within said cap during storage, and a first part of a releasable fastening device provided about the outer periphery of said cap for securing said protective device to said cap during use, said removable protective device including:

a sweat band defining an open center portion, said sweat band including a second part of the releasable fastening device adapted to engage the first part of the releasable fastening device on said cap to removably secure said protective device to said cap;

a continuous, flexible outer spring wire frame; and a weather-proof cover stretched between said sweat band and said wire frame to form a protective brim for said cap; wherein said protective cover may be removed from and store within said cap during periods of non-use by unfastening said first part of the releasable fastening device from the second part of the releasable fastening device, twisting said protective device in a figure eight configuration about said continuous wire frame, and folding said twisted protective device into a flat arrangement for storage within said cap where it is supported by said support means.

* * * * *